United States Patent [19]

Poehlman

[11] Patent Number: 4,598,673

[45] Date of Patent: Jul. 8, 1986

[54] AIR-SCAVENGED TWO-CYCLE INTERNAL COMBUSTION ENGINE

[75] Inventor: Arthur G. Poehlman, West Bend, Wis.

[73] Assignee: Outboard Marine Corporation, Waukegan, Ill.

[21] Appl. No.: 698,884

[22] Filed: Feb. 6, 1985

[51] Int. Cl.[4] ..... F02B 33/04

[52] U.S. Cl. ..... 123/73 PP; 123/73 C; 123/73 B; 123/65 A

[58] Field of Search ..... 123/73 A, 73 R, 73 PP, 123/65 A, 65 PE, 74 AE, 73 CC

[56] References Cited

U.S. PATENT DOCUMENTS

| | | | |
|---|---|---|---|
| 1,527,166 | 2/1925 | Bezu | 123/73 CC |
| 3,363,611 | 1/1968 | Seggern et al. | 123/65 |
| 4,067,302 | 1/1978 | Ehrlich | 123/73 PP |
| 4,075,985 | 2/1978 | Iwai | 123/73 A |
| 4,176,631 | 12/1979 | Kanao | 123/73 PP |
| 4,248,185 | 2/1981 | Jaulmes | 123/73 R |
| 4,253,433 | 4/1981 | Blair | 123/73 R |
| 4,340,016 | 7/1982 | Ehrlich | 123/73 R |

FOREIGN PATENT DOCUMENTS

| | | | |
|---|---|---|---|
| 72361 | 9/1966 | Fed. Rep. of Germany | 123/73 PP |

*Primary Examiner*—E. Rollins Cross

*Attorney, Agent, or Firm*—Michael, Best & Friedrich

[57] ABSTRACT

The two-cycle internal combustion engine has a crankcase, a combustion chamber including an exhaust port, a fuel intake port and a pair of air-intake ports located on the opposite sides of the fuel intake port, and a piston movable relative to the combustion chamber between top dead center and bottom dead center positions. The crankcase has separate air and fuel inlets and includes interior portions defining an air crankcase portion which communicates with the crankcase air inlet and with two air transfer passages which communicated with the air intake ports and a separate fuel crankcase portion which communicates with the crankcase fuel inlet and a fuel transfer passage which communicates with the fuel intake port. Air is drawn through the crankcase air inlet into the air crankcase portion and a fuel-air mixture is drawn through the crankcase fuel inlet into the fuel crankcase portion during the upstroke of the piston toward top dead center. During the downstroke of the piston toward bottom dead center, air flows from air crankcase portion into both air transfer passages and the fuel-air mixture is kept separate from the air as it flows from the fuel crankcase portion into the fuel transfer passage. The exhaust, air intake and fuel intake ports are located relative to each other so that the air intake ports are uncovered to admit air into the combustion chamber for scavenging the exhaust gases through the exhaust port before the fuel intake port is uncovered.

12 Claims, 5 Drawing Figures

AIR-SCAVENGED TWO-CYCLE INTERNAL COMBUSTION ENGINE

BACKGROUND OF THE INVENTION

This invention relates to two-cycle internal combustion engines and, more particularly, to two-cycle internal combustion engines including air scavenging.

The cylinder of two-cycle internal combustion engines typically includes a combustion chamber having one or more exhaust ports and one or more fuel intake ports which are covered by the piston during the piston compression or upstroke and are uncovered during the piston expansion or downstroke. The exhaust port(s) is opened first during the piston downstroke to permit the combustion gases to be exhausted from the combustion chamber. The fuel intake ports are subsequently opened to admit an air-fuel mixture, which is compressed in the engine crankcase during the piston downstroke, into the combustion chamber. The incoming pressurized air-fuel mixture flows toward the exhaust port(s) and scavenges or expels remaining combustion gases from the combustion chamber.

In cross-scavenged engines, the exhaust and fuel intake ports generally are diametrically opposed and the top end of the piston includes a baffle arranged to direct the flow of the incoming air-fuel mixture upwardly. A loop-scavenged engine includes side fuel intake ports which are arranged to introduce a portion of the air-fuel mixture into the combustion chamber at an angle so as to promote a swirling action. In either type, a considerable amount of the uncombusted air-fuel mixture can be lost through the exhaust port(s) during the scavenging of the combustion gases from the combustion chamber, resulting in ineffiency and an increase in polluting emissions.

One proposed approach for minimizing overscavenging involves scavenging the combustion chamber with air only during most of or the entire downstroke of the piston and thereafter injecting fuel into the combustion chamber. This approach requires a fuel injection system and costly controls. Also, the power produced by the engine at high speeds and loads is less than that produced by conventional engines because there is insufficient time for the fuel and air to mix prior to combustion.

Another proposed approach involves introducing an air-fuel mixture from a carburetor directly into the combustion chamber through a fuel intake port located farthest away from the exhaust port and drawing air into the engine crankcase and then introducing air from the crankcase into the combustion chamber through one or more intake ports located closer to the exhaust port. A further proposed approach involves the use of a chamber which is exterior to and separated from the crankcase by a flexible membrane for pumping air into one or more intake ports.

Attention is directed to the following U.S. patents:

| Patentee | U.S. Pat. No. | Issue Date |
|---|---|---|
| Bezu | 1,527,166 | February 24, 1925 |
| De Waern | 2,406,491 | August 27, 1946 |
| Von Seggern et al. | 3,363,611 | January 16, 1968 |
| Iwai | 4,075,985 | February 28, 1978 |

Attention is also directed to British Patent No. 703,916.

SUMMARY OF THE INVENTION

The invention provides a two-cycle internal combustion engine including a crankcase, a combustion chamber having an exhaust port, a fuel intake port, and an air intake port at a location closer to the exhaust port than the fuel intake port, and a piston movable relative to the combustion chamber through a compression stroke to cover all the ports and through an expansion stroke to uncover all the ports. The crankcase includes an air inlet, a fuel inlet, and interior dividing means defining an air passageway or crankcase portion which communicates with the crankcase inlet and with the air intake port and defining a separate fuel passageway or crankcase portion which communicates with the crankcase fuel inlet and the fuel intake port. Means are providing for admitting a fuel-air mixture into the crankcase fuel inlet and for admitting air into the crankcase air inlet.

In one embodiment, the fuel intake and air inlet ports are located relative to each other and to the exhaust port to provide cross-scavenging of the combustion chamber.

In one embodiment, a pair of air intake ports are provided, these air intake ports air circumferentially spaced from the opposite sides of the fuel intake port, and the fuel intake port and the air intake ports are located relative to each other and to exhaust port to provide loop-scavenging of the combustion chamber.

In one embodiment, the crankcase dividing means includes partition means cooperating with the engine crankshaft to define a portion of the fuel crankcase portion.

In one embodiment, the engine includes a fuel transfer passage communicating with the fuel intake port and having an inlet opening, the crankshaft includes a pair of axially spaced counterweights having respective circular peripheral surfaces and radially extending inner surfaces, and the crankcase dividing means includes transversely spaced walls inside the crankcase which extend generally perpendicularly to the crankshaft axis, each having an arcuate apertures closely fitting to the peripheral surface of one of the counterweights, and which cooperate with the counterweights to define the fuel crankcase portion which communicates with the crankcase fuel inlet and with the transfer passage inlet and which includes the space between the inner surface of the counterweights.

In one embodiment, the dividing means includes a pair of spaced skirts mounted on the piston for common movement therewith and extending on opposite sides of the connecting rod into the space between the counterweights and fitting closely to the inner surfaces of the counterweights and to the interior of the crankcase. The space between the skirts communicates with the fuel transfer passage inlet.

One of the principal features of the invention is the provision of a two-cycle internal combustion engine including means for introducing air into the combustion chamber to scavenge exhaust gases therefrom before a fresh charge of a fuel-air mixture is introduced into a combustion chamber.

Another of the principal features of the invention is the provision of such a two-cycle engine which does not require a separate fuel injection system and/or costly controls.

Another of the principal features of the invention is the provision of a two-cycle internal combustion engine arranged so that both air and a fuel-air mixture is drawn into the engine crankcase during the piston upstroke and are maintained separate and delivered to the combustion chamber through separate intake ports during the piston downstroke without the need for complicated controls.

Other features, advantages and aspects of the invention will become apparent to those skilled in the art upon reviewing the following detailed description, the drawing and the appended claims.

Figure 1:
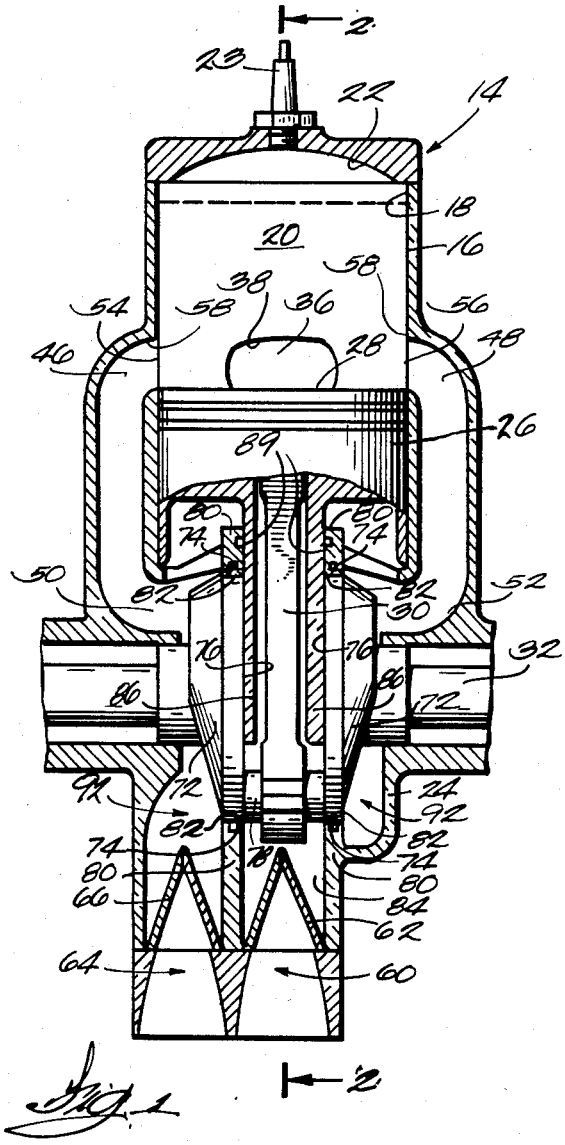
FIG. 1 is a fragmentary, side sectional view of an internal combustion engine incorporating various of the features of the invention and arranged to provide loop-scavenging.

Before explaining at least one of the embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENTS

Figure 2:
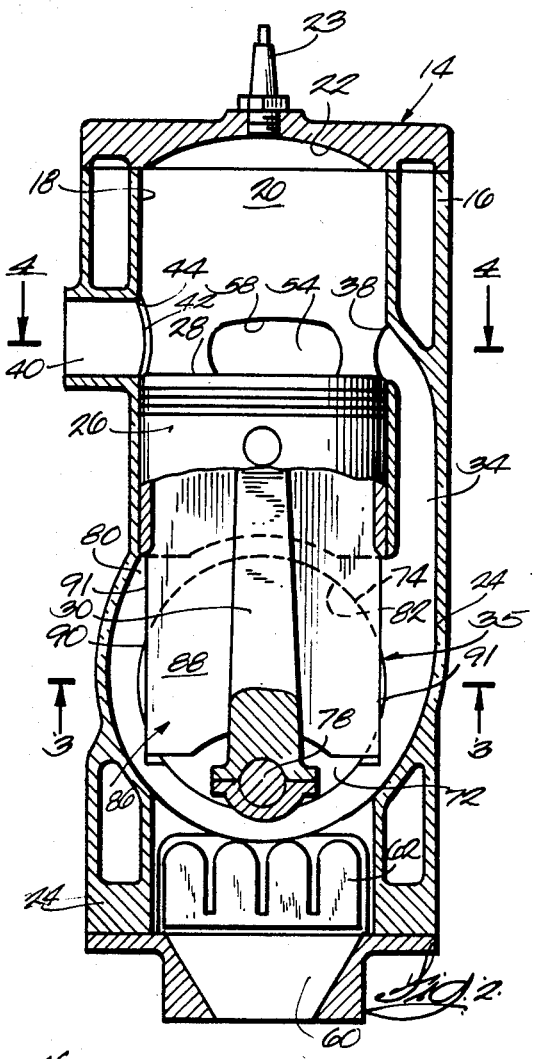
FIG. 2 is a sectional view taken generally along line 2—2 in FIG. 1.
Figure 3:
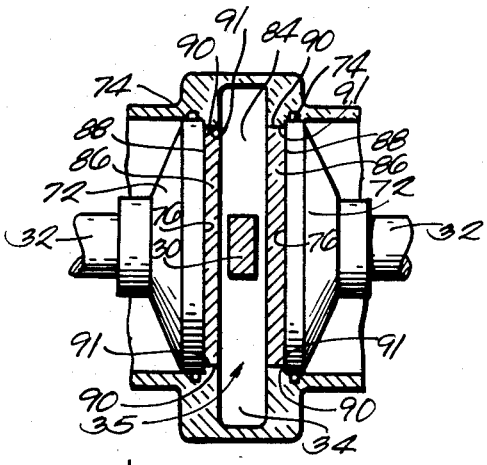
FIG. 3 is a sectional view taken generally along line 3—3 in FIG. 2.
Figure 4:
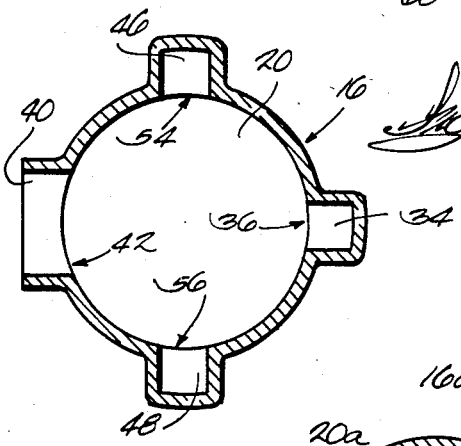
FIG. 4 is a sectional view taken generally along line 4—4 in FIG. 2.

Illustrated in FIGS. 1 and 2 is a two-cycle internal combustion engine 14 including a block 16 defining a cylinder 18 having a combustion chamber 20 and a head end 22. Mounted in the head end 22 of the cylinder 18 is a spark plug 23 for igniting a fuel-air mixture introduced into the combustion chamber 20.

A crankcase 24 extends from the combustion chamber 20. Mounted for reciprocating movement inside the cylinder 18 is a piston 26 which has an upper edge 28 and which is connected, via a connecting rod 30 to a crankshaft 32 extending through the crankcase 24. Reciprocating movement of the piston 26 through a compression or upstroke and through an expansion or downstroke respectively produces relatively low and high pressure conditions inside the crankcase 24. Maximum crankcase pressure exists when the piston 26 is at bottom dead center (illustrated by solid lines in FIG. 1) and a minimum crankcase pressure exists when the piston 26 is at top dead center (illustrated by phantom lines in FIG. 1).

A fuel-air mixture is introduced into the crankcase 24 in response to variations in the crankcase pressure as described in more detail below. The crankcase 24 is connected in communication with the combustion chamber 20 by a fuel transfer passage 34 (FIG. 2) extending in the engine block 16. The fuel transfer passage 34 includes an inlet 35 and terminates at the cylinder wall in a fuel intake port 36 having an upper edge 38 located at a predetermined distance from the head end 22 of the cylinder 18. A charge of the fuel-air mixture, flowing from the crankcase 24 through the transfer passage 34, is introduced into the combustion chamber 20 as the upper edge 28 of the piston 26 uncovers the fuel intake port 36 during travel from top dead center toward bottom dead center.

The engine block 16 includes an exhaust passage 40 terminating at the cylinder wall in an exhaust port 42 having an upper edge 44 located at a predetermined distance from the cylinder head end 22. Combustion products or exhaust gases are exhausted from the combustion chamber 20 and discharged through the exhaust passage 40 as the upper edge 28 of the piston 26 uncovers exhaust port 42 during travel from top dead center toward bottom dead center.

The exhaust port 42 is generally diametrically opposite to the fuel intake port 36. The upper edge 44 of the exhaust port 42 preferably is located closer to the cylinder head end 22 than the upper edge 38 of the fuel intake 36 so that the exhaust gas port 42 is uncovered before the fuel intake port 36.

Means are provided for introducing air into the combustion chamber 22 to scavenge or purge the exhaust gases through the exhaust port 42 and thereby reduce the loss of the incoming fuel-air mixture through the exhaust port 42. In the embodiment illustrated in FIGS. 1–4, the crankcase 24 is connected in communication with the combustion chamber 20 by a pair of air transfer passages 46 and 48 (FIG. 1) extending in the engine block 16 on the opposite sides of the fuel transfer passage 34. The air transfer passages 46 and 48 have respective inlet openings 50 and 52 and terminate at the cylinder wall in respective air intake ports 54 and 56 circumferentially spaced from the opposite sides of the fuel intake port 36. The air intake ports 54 and 56 have an upper edge 58 preferably located at a predetermined distance closer to the cylinder head end 22 than the upper edge 38 of the fuel intake port 36, but farther away from the cylinder head end 20 than the upper edge 44 of the exhaust 42.

In the embodiment illustrated in FIGS. 1–4, the air intake ports 54 and 56 are located relative to the fuel intake port 36 and to the exhaust port 42 so that air introduced through the air intake ports 54 and 56 provides loop-scavenging.

When a low pressure condition is produced in the crankcase 24 during the upstroke of the piston 26 toward top dead center, a fuel-air mixture supplied from a conventional carburetor (not shown) is drawn into the crankcase 24 through a fuel inlet 60 including a conventional reed valve assembly 62. At the same time, air from the atmosphere or another suitable source is drawn into the crankcase 24 through an air inlet 64 including a conventional reed valve assembly 66.

Means interior of the crankcase 24 are provided for maintaining the incoming fuel-air mixture and air separate from each other and for directing the fuel-air mixture into the fuel transfer passage 34 and the air into the air transfer passages 46 and 48 when a high pressure condition is produced in the crankcase 24 during the downstroke of the piston 26 toward bottom dead center. More specifically, dividing means interior of the crankcase 24 are provided to define an air passageway or crankcase portion 92 which communicates with the crankcase air inlet 64 and with the air transfer passage inlets 50 and 52 and to define a separate fuel passageway or crankcase portion 84 which communicates with the crankcase fuel inlet 60 and with the fuel transfer passage inlet 35.

In the specific construction illustrated, the crankshaft 32 includes a pair of axially spaced counterweights 72, each having a circular peripheral surface 74 and a radially extending inner surface 76. One end of the connecting rod 30 is disposed between and pivotally connected to the counterweight by a pin 78 or the like and the opposite end is pivotally connected to the piston 26.

The crankcase 24 includes a pair of transversely spaced partitions or walls 80 which extend generally perpendicularly to the crankshaft axis and which, in general, radially register with the counterweights 72. Each of the walls 80 has a circular aperture 82 which fits closely to the peripheral surface 74 of a counterweight 72. The fuel crankcase portion 84 includes the space between the walls 80 and communicates with the crankcase fuel inlet 60 via the reed valve assembly 62 and with the fuel transfer inlet 35.

Extending from the bottom portion of the piston 26 and between the counterweights 72 and the connecting rod 30 is a pair of plate-like skirts 86 having outer surfaces 88 (FIG. 3) which fit closely to the inner surfaces 76 of the counterweights 72 and the inner surfaces 89 of the upper portion of the walls 80. The piston skirts 88 have opposite edges 90 (FIGS. 2 and 3) which fit closely to complementary surfaces 91 inside the crankcase 24. Piston skirts 86 move with the piston 26 and serve to maintain the fuel passageway 84 separate from the remainder of the interior of the crankcase 24 during piston travel from bottom dead center to top dead center.

The crankcase 24 also includes the above-mentioned air passageway or crankcase portion 92 which communicates with the crankcase air inlet 64 via the reed valve 66 and with both air transfer passage inlets 50 and 52. The air crankcase portion 92 is arranged so that, even though there is only a single crankcase air inlet 64, balanced pressures are delivered through both the air intake ports 46 and 48 for scavenging during the downstroke of the piston 26 toward bottom dead center.

During engine operation, both air and a fuel-air mixture are drawn into the crankcase 24 through the crankcase air inlet 64 and the crankcase fuel inlet 60, respectively, during the upstroke of the piston 26 toward top dead center. The fuel-air mixture is kept separately from the air by the fuel crankcase portion 84 defined by the crankcase walls 80 and the piston skirts 88. During the downstroke of the piston 26 towards bottom dead center, the exhaust port 42, the air intake ports 54 and 56, and the fuel intake port 36 are uncovered. Air flows from the air crankcase portion 92 and into both air transfer passages 46 and 48. The fuel-air mixture is kept separate from the air as it flows from the fuel crankcase portion 84 into the fuel transfer passage 34. Because of the relative locations of the upper edges 38, 44, and 58, the exhaust port 42 opens first, the air intake ports 54 and 56 open next and admit air into the combustion chamber 20 from the air transfer passages 46 and 48 for scavenging exhaust gases through the exhaust port 42, and the fuel intake port 36 opens last to admit a fresh charge of the fuel-air mixture into the combustion chamber 20 from the fuel transfer passage 34.

The mixture ratio of the fuel-air mixture is adjusted to account for the additional air continuing to enter through the air intake ports 54 and 56 until they are covered by the piston 26 during travel toward top dead center.

The pressures of the air in the air crankcase portion 92 and the fuel-air mixture in the fuel crankcase portion 84 usually are insufficiently different to require extra sealing means between the peripheral surface 74 of the counterweights 72 and the crankcase wall apertures 82 between the outer surfaces 88 of the piston skirts 86 and the inner surfaces 89 of the crankcase walls 80 and/or between the edges 90 of the piston skirts 86 and the crankcase surfaces 91 as illustrated in FIG. 1.

Figure 5:
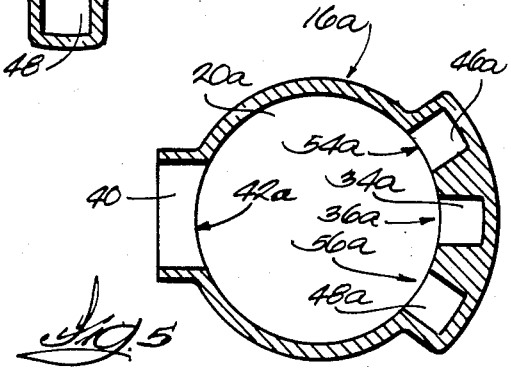
FIG. 5 is a top sectional view of an alternate embodiment arranged to provide cross-scavenging.

The invention can be used to provide cross-scavenging in addition to providing loop-scavenging as in the embodiment illustrated in FIGS. 1–4. FIG. 5 illustrates the port arrangement for providing cross-scavenging. Parts providing functions like parts in the embodiment illustrated in FIGS. 1–4 are designated with the same reference numeral and the letter "a".

The engine block **16*a* includes a fuel transfer passage 34*a* communicating with the fuel passageway 84 and terminating at the cylinder wall in a fuel intake port 36*a*, an exhaust passage 40*a* terminating at the cylinder wall in an exhaust port 42*a* diametrically opposed to the fuel intake port 36*a*, and a pair of air transfer passages 46*a* and 48*b* communicating with the air passageway 92 and terminating at the cylinder wall in air intake ports 54*a* and 56*a* and located near the opposite sides of the fuel intake port 36. The upper edges of these ports are located relative to each other in the same manner as described above in connection with the embodiment illustrated in FIGS. 1–4**.

Various of the features of the invention are set forth in the following claims.

I claim:

1. A two-cycle internal combustion engine comprising a crankcase including a rotatable crankshaft, a cylinder extending from said crankcase and including a combustion chamber having a head end, an exhaust port in said cylinder communicating with said combustion chamber, a fuel intake port in said cylinder communicating with said combustion chamber, an air intake port in said cylinder communicating with said combustion chamber at a location closer to said exhaust port than said fuel intake port, a piston operably connected to said crankshaft and mounted for reciprocative movement in said cylinder through a compression stroke to cover all of said ports and through an expansion stroke to uncover all of said ports, an air inlet in said crankcase, a fuel inlet in said crankcase, dividing means located interiorly of said crankcase and defining an air crankcase portion which communicates with said crankcase air inlet and with said air intake port and further defining a separate fuel crankcase portion which communicates with said crankcase fuel inlet and with said fuel intake port, means for admitting a fuel-air mixture into said crankcase fuel inlet, and means for admitting air into said crankcase air inlet.

2. A two-cycle internal combustion engine according to claim 1 wherein said fuel intake and air intake ports have respective upper edges and said upper edge of said air intake port is located closer to said combustion chamber head end than said upper edge of said fuel intake port.

3. A two-cycle internal combustion engine according to claim 2 wherein said exhaust port has an upper edge located closer to said combustion chamber head end than said upper edge of said air intake port.

4. A two-cycle internal combustion engine according to claim 1 wherein said fuel intake and air inlet ports are located relative to each other and to said exhaust port to provide cross-scavenging of said combustion chamber.

5. A two-cycle internal combustion engine according to claim 1 including a pair of said air intake ports respectively circumferentially spaced from the opposite sides of said fuel intake port and wherein said fuel intake port and said air intake ports are located relative to each other and to said exhaust port to provide loop-scavenging of said combustion chamber.

6. A two-cycle internal combustion engine comprising a crankcase including a rotatable crankshaft including a pair of axially spaced counterweight having respective circular peripheral surfaces and radially extending inner surfaces, a cylinder extending from said crankcase and including a combustion chamber having a head end, an exhaust port in said cylinder communicating with said combustion chamber, a fuel intake port in said cylinder communicating with said combustion chamber, an air intake port in said cylinder communicating with said combustion chamber at a location closer to said exhaust port than said fuel intake port, a piston operably connected to said crankshaft and mounted for reciprocative movement in said cylinder through a compression stroke to cover all of said ports and through an expansion stroke to uncover all of said ports, a connecting rod having one end pivotally connected to said piston and the opposite end pivotally connected to and between said counterweights, an air inlet in said crankcase, a fuel inlet in said crankcase, dividing means located interiorly of said crankcase and defining an air crankcase portion which communicates with said crankcase air inlet and with said air intake port and further defining a separate fuel crankcase portion which communicates with said crankcase fuel inlet, said crankcase dividing means including partition means including spaced walls in said crankcase extending generally perpendicularly to the crankshaft axis and respectively including arcuate apertures closely fitting to said peripheral surfaces of said counterweights, said walls cooperating with said counterweights to define said fuel crankcase portion which includes a space between said inner surfaces of said counterweights, a fuel transfer passage communicating with said space and with said fuel intake port, means for admitting a fuel-air mixture into said crankcase fuel inlet, and means for admitting air into said crankcase air inlet.

7. A two-cycle internal combustion engine according to claim 6 wherein said dividing means includes a pair of spaced skirts mounted on said piston for common movement therewith and extending on opposite sides of said connecting rod into said space between said counterweights and fitting closely to said inner surfaces of said counterweights and to the interior of said crankcase.

8. A two-cycle internal combustion engine according to claim 6 wherein said fuel intake and air intake ports have respective upper edges and said upper edge of said air intake port is located closer to said combustion chamber head end than said upper edge of said fuel intake port.

9. A two-cycle internal combustion engine according to claim 8 wherein said exhaust port has an upper edge located closer to said combustion chamber head end than said upper edge of said air intake port.

10. A two-cycle internal combustion engine according to claim 6 wherein said fuel intake and air inlet ports are located relative to each other and to said exhaust port to provide cross-scavenging of said combustion chamber.

11. A two-cycle internal combustion engine according to claim 6 including a pair of said air intake ports respectively circumferentially spaced from the opposite sides of said fuel intake port and wherein said fuel intake port and said air intake ports are located relative to each other and to said exhaust port to provide loop-scavenging of said combustion chamber.

12. A two-cycle internal combustion engine comprising a crankcase, a cylinder extending from said crankcase and including a combustion chamber, a fuel intake port in said cylinder communicating with said combustion chamber, an air intake port in said cylinder communicating with said combustion chamber, an air inlet in said crankcase, a fuel inlet in said crankcase, and dividing means located interiorly of said crankcase and defining an air crankcase portion which communicates with said crankcase air inlet and with said air intake port and further defining a separate fuel crankcase portion which communicates with said crankcase fuel inlet and with said fuel intake port.

* * * * *